US006402242B1

(12) United States Patent
Bellefleur

(10) Patent No.: US 6,402,242 B1
(45) Date of Patent: Jun. 11, 2002

(54) LOCKING ASSEMBLY FOR A ROCKING CHAIR

(75) Inventor: Pierre Bellefleur, Magog (CA)

(73) Assignee: Dutailier International Inc., Quebec (CA)

( * ) Notice: Subject to any disclaimer, the term of this patent is extended or adjusted under 35 U.S.C. 154(b) by 0 days.

(21) Appl. No.: 09/518,886

(22) Filed: Mar. 6, 2000

(30) Foreign Application Priority Data

Jan. 13, 2000 (CA) ..... 2296032

(51) Int. Cl.[7] ..... A47C 31/00; A47C 3/02

(52) U.S. Cl. ..... 297/270.1; 297/270.3; 297/270.4; 297/374; 297/270.2; 74/577; 74/575; 74/527; 74/531; 74/578; 74/541

(58) Field of Search ..... 297/270.1, 270.2, 297/270.3, 270.4, 370, 371, 373, 366, 365, 375; 74/527, 530, 531, 578, 577 M, 575, 533, 534, 540, 541

(56) References Cited

U.S. PATENT DOCUMENTS 4,469,301 A * 9/1984 Chevalier ..... 74/540
4,591,207 A * 5/1986 Nithammer et al. .... 297/366 X
4,736,156 A * 4/1988 Pipon et al. ..... 74/531
6,213,551 B1 * 4/2001 Desnoyers et al. ..... 297/270.4

* cited by examiner

*Primary Examiner*—Anthony D. Barfield
(74) *Attorney, Agent, or Firm*—Ladas & Parry

(57) ABSTRACT

The present invention relates to a locking assembly for a rocking chair. The locking assembly includes a pair of jaws mounted to the body-supporting portion of the chair and a set of pins mounted to the chair base portion of the chair. The jaws are operable to engage a selected pin to lock the body-supporting portion of the chair relative the chair base portion in a position that corresponds to the selected pin. The jaws include gripping faces that spread apart to define a recess when the locking assembly is operated. At the same time the gripping faces move toward the pin to cause the pin to enter the recess such that the pin becomes wedged in the recess.

24 Claims, 6 Drawing Sheets

LOCKING ASSEMBLY FOR A ROCKING CHAIR

FIELD OF THE INVENTION

The present invention relates to the art of manufacturing chairs and, more particularly, to a novel locking assembly for rocking chairs. The locking assembly is characterized by its ability to lock the body portion of the chair relative to the base portion of the chair in a selected position.

BACKGROUND OF THE INVENTION

A typical rocking chair includes a body supporting structure that is mounted on a chair base by a rocking assembly. The prior art has recognized that it is desirable to provide rocking chairs with a locking mechanism that allows retaining the body-supporting portion of the chair in a certain position with relation to the base. This is useful in instances where the occupant of the chair wishes to negate at least temporarily the rocking function of the chair.

One locking mechanism that is known in the art comprises two components, namely a rack element including a plurality of fingers in a spaced apart relationship, and a pin element that can fit between selected fingers of the rack. The rack element is mounted to the body-supporting portion of the chair while the pin is mounted to the chair base portion. The rack element is also provided with a linkage that allows moving the rack in and out of engagement with the pin. In use, when the occupant of the chair desires to lock the chair in a certain position, he or she operates the linkage to bring the rack in engagement with the pin such that the pin enters the fingers that correspond to the selected position in which the chair is to be immobilized. To release the lock, it suffices to operate the linkage in the opposite direction and thus disengage the rack from the pin.

This type of locking mechanism is not entirely satisfactory for a number of reasons. One of its drawbacks relates to the smoothness of operation. For instance, the rack will engage with the pin only when the inter-pin space is precisely aligned with the pin. In a situation when the occupant of the chair attempts to engage the locking mechanism in a position such that a finger of the rack interferes with the pin, engagement will not be possible until the occupant of the chair slightly shifts the position of the body-supporting portion of the chair such that the pin enters between two fingers of the rack.

Another drawback is the requirement of providing a long rack when a wide range of locking positions on the chair are desirable, which may not be aesthetically advantageous.

Against this background, it clearly appears that there is a need in the industry to provide a locking assembly for rocking chairs that avoid or at least alleviate drawbacks associated with prior art locking assemblies.

SUMMARY OF THE INVENTION

In one aspect the present invention provides a locking assembly for a rocking chair, the rocking chair having a body-supporting portion mounted for rocking movement on a chair base portion. The locking assembly comprises a first locking assembly component for mounting to body-supporting portion and a second locking assembly component for mounting to the chair base portion. The first and the second locking assembly components can be interlocked to retain the body-supporting portion at a selected position relative the chair base portion.

The first locking assembly component includes a pair of jaws capable to acquire two operative conditions. The second locking assembly component includes at least one pin. In the first operative condition, the jaws wedge the pin between them and thus retain the body-supporting portion of the chair relative the base portion of the chair in a certain position, preventing the body-supporting portion of the chair from rocking. In the second operative position, the jaws release the pin, allowing the pin to move relatively to the jaws such as to allow the chair to rock.

An advantage of the locking mechanism over prior art designs is its smoothness of operation. As the first locking assembly component is operated to cause the pin to become wedged between the jaws, the jaws and consequently the body-supporting portion of the chair, are guided toward the locking position where the jaws engage the pin. There is no necessity for the occupant of the chair, to gage and adjust the position of the body-supporting portion of the chair relatively to the chair base portion such as to allow the two components of the locking assembly to interengage. Another advantage of this locking assembly is its low profile. To extend the range of locking positions, it suffices to add more pins to the chair base, where each pin corresponds to a different locking position. Since the pins are relatively small, the locking mechanism remains discreet.

One possible variant of the structure described above is to reverse the position of the locking assembly components, and mount the first locking assembly component to the chair base portion while mounting the second locking assembly component to the body-supporting portion of the chair.

In a specific nonlimiting example of implementation, the first locking assembly component includes a pair of jaws that move with relation to one another when a linkage is operated. Typically, the linkage includes a handle that extends on the side of the chair and that can be operated by the user to open or to close the jaws. The relationship between the jaws is such that when a movement is imparted to one jaw by the linkage, the other jaw is also caused to move. When the linkage is operated to engage the locking assembly, the jaws move with relation to one another such as to grip the pin. In particular, the gripping faces of the jaws undergo motions in two directions. First, the gripping faces move away from one another such as to define a receptacle for receiving the pin. Second, the gripping faces move down to come and bear on the pin, thus immobilizing it. The arrangement between the various parts forming the gripping assembly is such that during the initial phase of the locking assembly engagement, the gripping faces of the jaws move faster away from one another than toward the pin. This arrangement allows to first form the pin catching receptacle and then to cause the receptacle to fit on the pin such as to wedge the pin. When the locking assembly is released, the opposite sequence of motions occurs.

The present invention also extends to a rocking chair including the locking assembly described above.

BRIEF DESCRIPTION OF THE DRAWINGS

In FIG. 1, only the structure of the chair is shown, the upholstery being removed for purposes of clarity;

DETAILED DESCRIPTION

Figure 1:
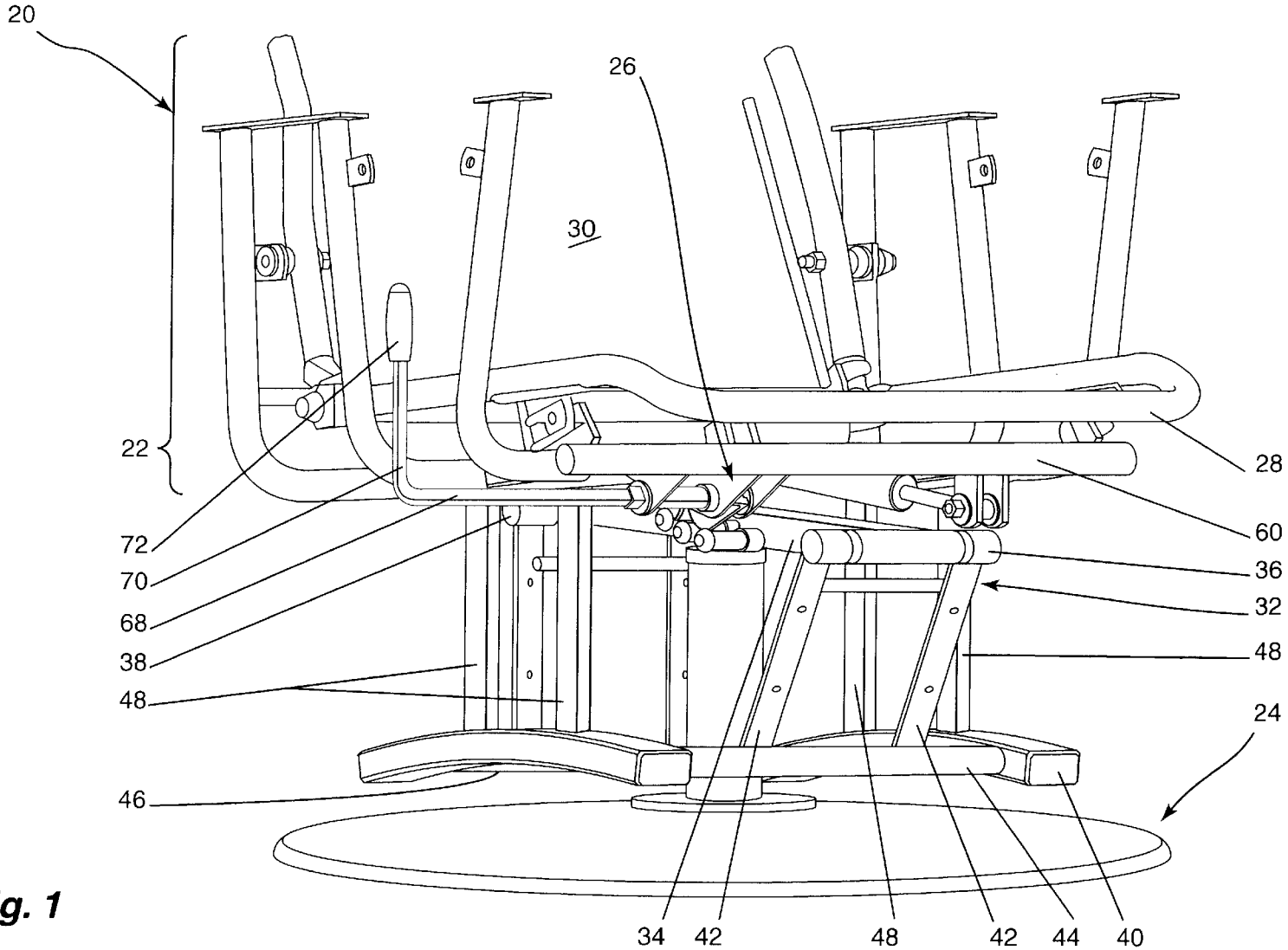
FIG. 1 is a perspective view of a rocking chair incorporating the locking assembly constructed according to the principles of the present invention.

FIG. 1 of the drawings illustrates a chair designated by the reference numeral 20 that embodies the principles of the present invention. The chair 20 can be broken down into three main components namely a body-supporting portion 22, a chair base portion 24 and a locking assembly 26 that allows the body supporting portion 22 to be interlocked with the chair base 24 at a selected position.

The body-supporting portion 22 comprises two main components namely a seat portion 28 and a backrest 30. The chair base portion 24 comprises a circular member of sufficient size to adequately support the chair 20 on the floor, although this is only a question of design since a wide variety of chair base portions can be used here without departing from the spirit-of the invention.

The body-supporting portion 22 is connected with the chair base portion 24 through the intermediary of a rocking mechanism 32 that allows the chair 20 to rock back and forth. The specific type of rocking mechanism is not critical for the success of this. As an example a rocking mechanism can be used that includes a horizontal bar 34 carrying at each end two hinges 36 and 38 that pivot about horizontal and parallel axes. A sub-frame 40, mounted below the seat portion 28 is connected to the hinges 36, 38 through links 42, themselves pivotally mounted to the sub-frame 40 at 44, 46 about horizontal axes that are parallel to the horizontal axes of the hinges 36, 38.

The body-supporting portion 22 is mounted to the rocking mechanism 32 by generally vertical bars 48 extending between the seat portion 28 and the sub-frame 40. This arrangement allows the body-supporting portion 22 to rock back and forth relative the chair base portion 24.

The locking assembly 26 is provided to lock the body-supporting portion 22 at a selected position with respect to the chair base 24. In a specific example of implementation, the locking assembly 26 provides a plurality of positions in which the body-supporting portion 22 can be locked relative the chair base portion The structure of the locking assembly 26 is illustrated in greater detail in FIGS. 3 to 10. The locking assembly 26 includes two components, namely a first locking assembly component 50 mounted to the body-supporting portion 22 and a second locking assembly component 52 mounted to the chair base portion 24. The first locking assembly component 50 comprises a pair of jaws that are operated by a linkage. The second locking assembly component 52 includes a plurality of pins, each pin corresponding to a different locking position of the body-supporting portion 22 with relation to the chair base portion 24. The locking assembly is in a locked condition when the jaws of the first locking assembly component 50 grip a pin of the second locking assembly component 52.

Figure 3:
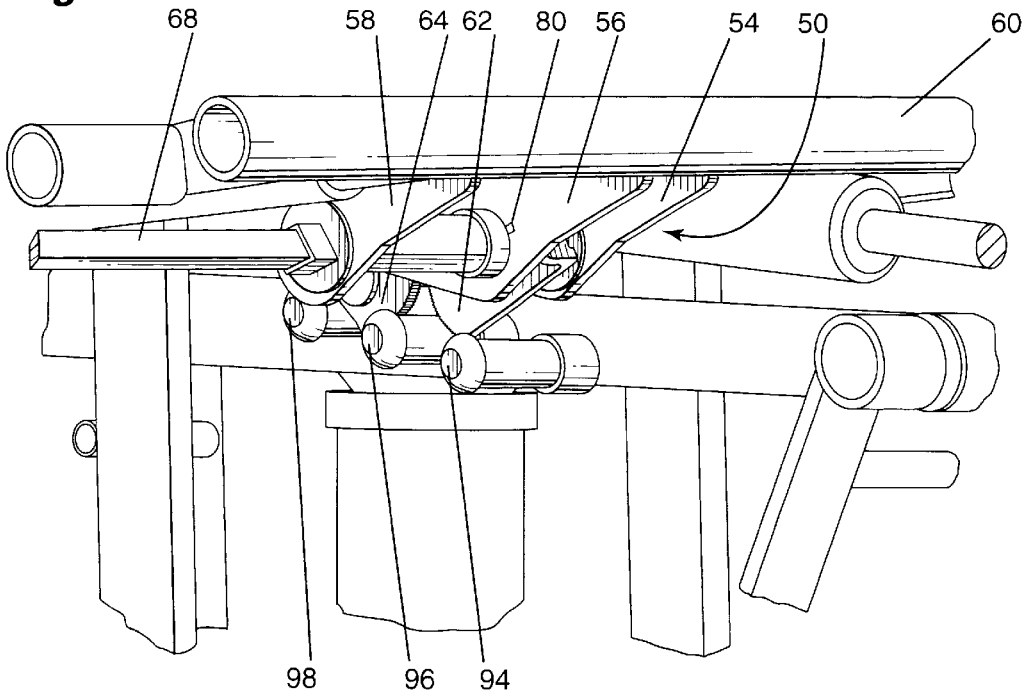
FIG. 3 is a further enlarged perspective view of the locking assembly depicted in FIG. 1, the locking assembly being engaged to prevent the chair from rocking.
Figure 4:
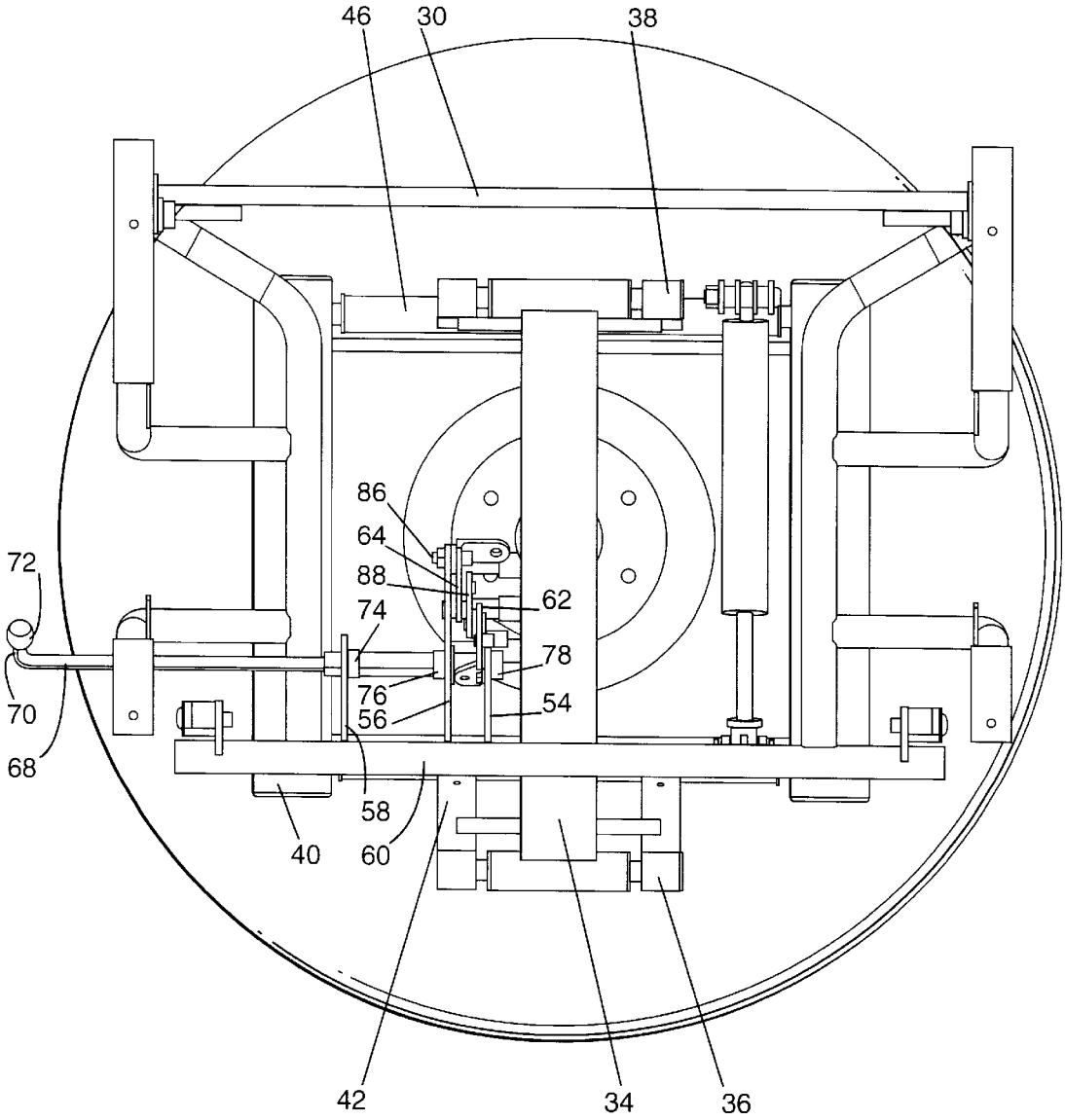
FIG. 4 is a top plan view of the chair depicted in FIG. 1.

With reference to FIG. 3, the first locking assembly component 50 comprises three generally parallel flat plates 54, 56 and 58 that are welded to a horizontal bar 60 forming part of the seat 28. The purpose of the three plates 54, 56 and 58 is to provide a structure allowing to pivotally support the various elements of the first locking assembly component 50. A pair of jaws 62 and 64 are mounted to the plates 54, 56.

Figure 9:
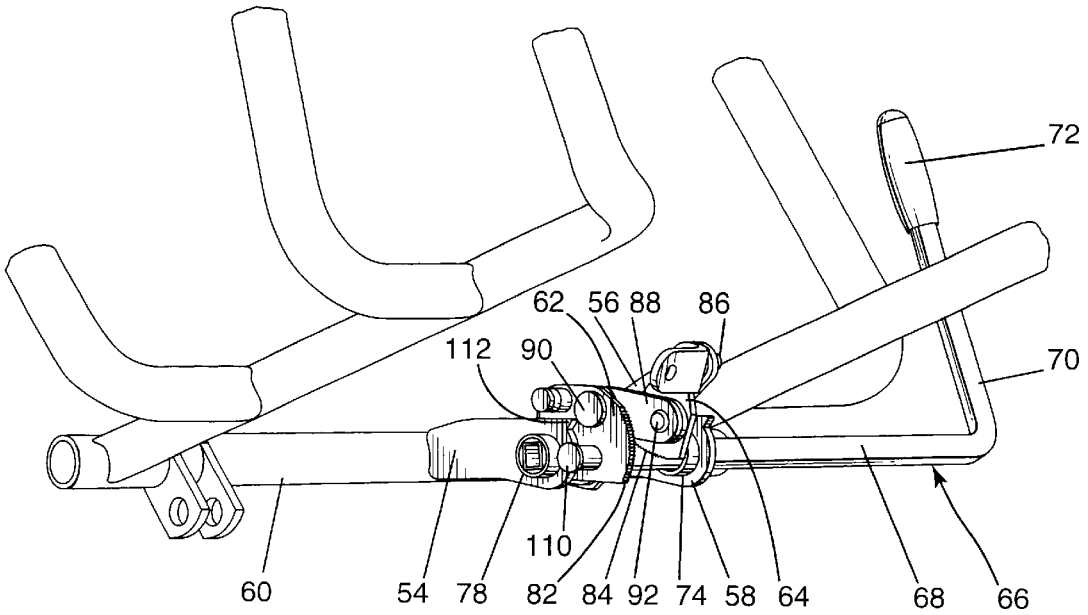
FIG. 9 is yet another perspective view from a different angle of the locking assembly in accordance with the invention, some components of the chair being also illustrated to provide a frame of reference.
Figure 10:
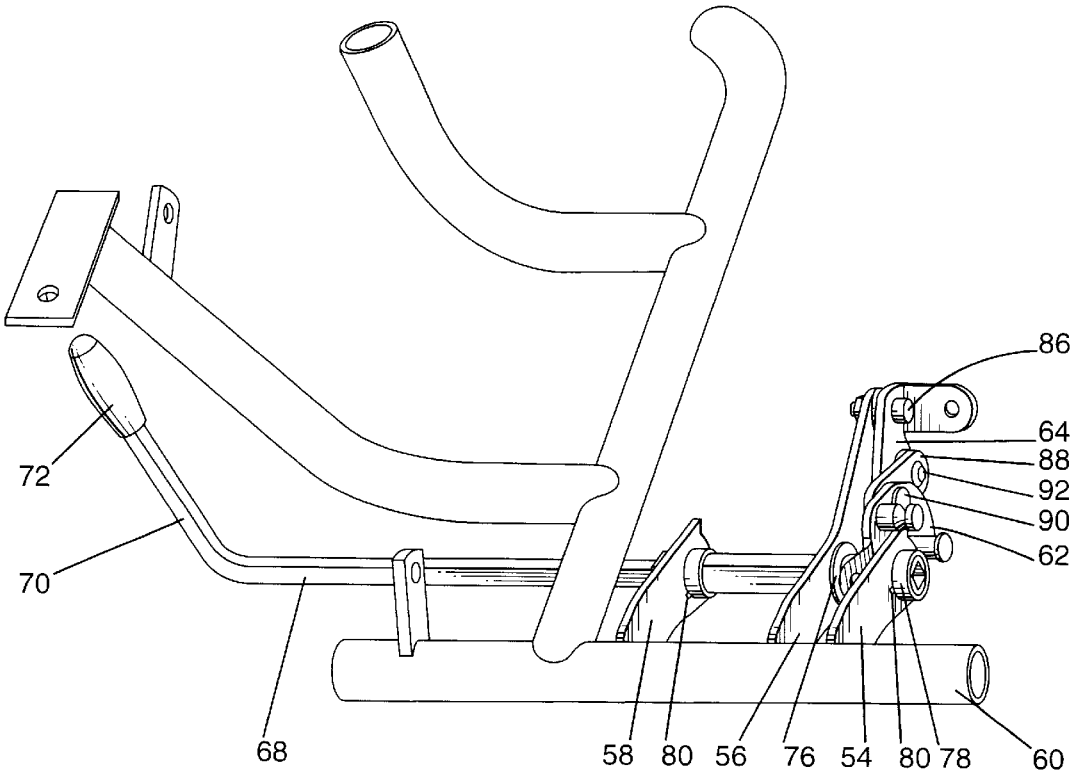
FIG. 10 is yet another different perspective view from of the locking assembly in accordance with the invention, some components of the chair being also illustrated to provide a frame of reference.

Referring now to FIG. 9, the linkage 66 includes a horizontal bar 68 of generally square cross-sectional shape bent to form an upwardly projecting portion 70 to which is mounted a handle 72. The handle 72 extends at the side of the body-supporting portion 22 such as to be accessible to the occupant of the chair 20. The horizontal bar 68 is pivotally mounted in the plates 58, 56 and 54 in bushings 74, 76 (shown in FIG. 10) and 78. In particular, the horizontal bar 68 is received in the central aperture of each bushing 74, 76 and 78 whose internal diameter is about the same as the diagonal length of the square cross-section of the horizontal bar 68. Each bushing 74, 76 and 78 has a generally circular outer shape received in a mating aperture in the respective plate 54, 56 and 58. To prevent the bushing 74, 76 and 78 from turning in the plate 54, 56 and 58, each bushing 74, 76 and 78 is provided with a projection 80 received in a corresponding recess of the plate 54, 56 and 58.

The jaw 62, that is in the form of a plate including a curved gripping face 82 is mounted to the horizontal bar 68 such as to pivot with it when the handle 72 is moved by the occupant of the chair 20. To accomplish this result, the jaw 62 is provided with a square aperture matching in size the cross-sectional shape of the horizontal bar 68. The square aperture locks the jaw 62 on the horizontal bar 68 and prevents any relative angular movement of the jaw 62 with relation to the horizontal bar 68.

The jaw 64 is also in the form of a flat plate with a gripping face 84 having about the same curvature as the curvature of the gripping face 82. The jaw 64 is pivotally mounted to the plate 56 at the pivot point 86. Motion is communicated from the jaw 62 to the jaw 64 by a short link 88 pivoted at 90 at the jaw 62 and at 92 at the jaw 64.

Figure 2:
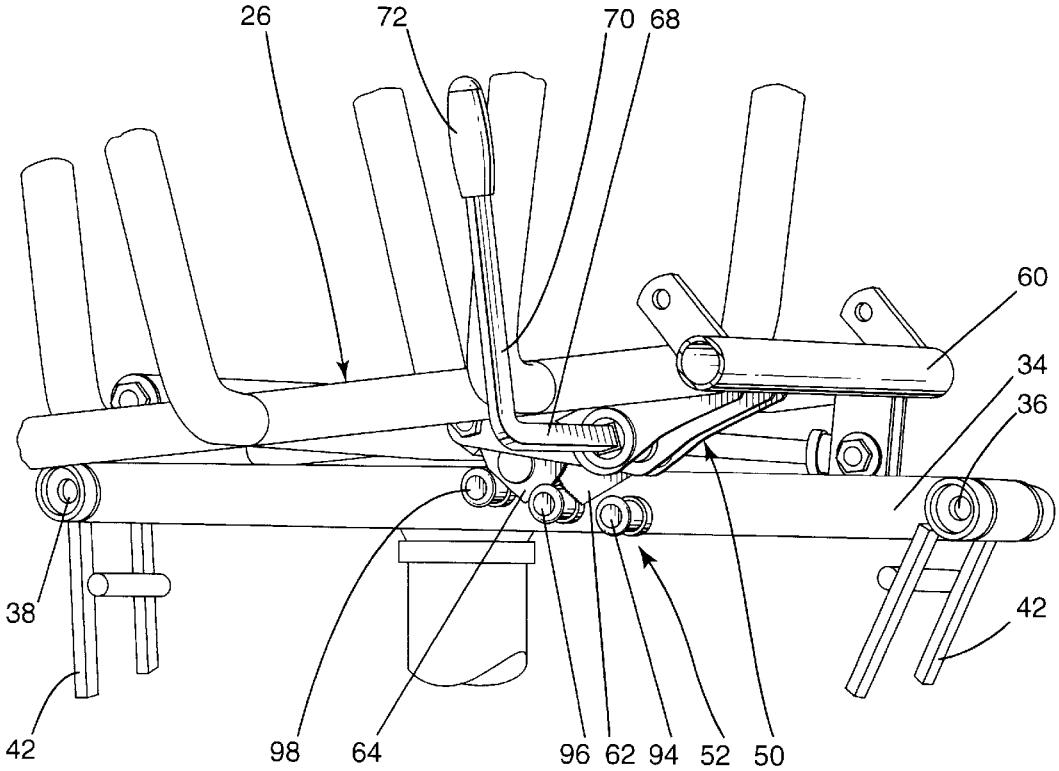
FIG. 2 is a enlarged perspective view of the locking assembly shown in FIG. 1.

Referring to FIG. 2, the second locking assembly component 52 includes a plurality of pins 94, 96 and 98 that are disposed along an arc of circle that follows the path of travel of the first locking assembly component 50 when the chair 20 is rocking. Each pin 94, 96 and 98 corresponds to a different locking position of the locking assembly 26.

Figure 5:
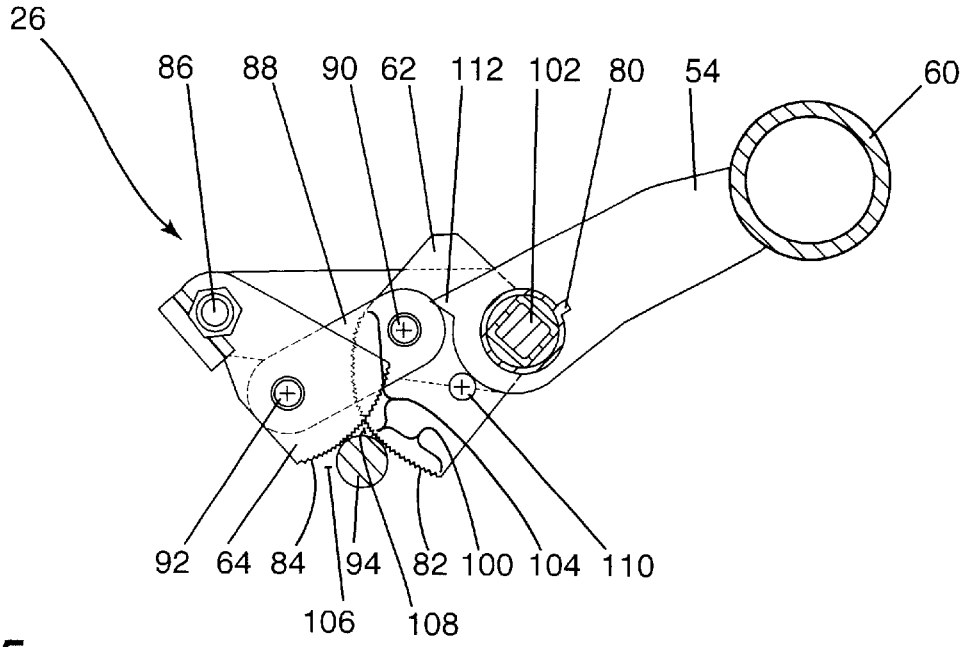
FIG. 5 is schematical view of the locking assembly, depicting the relative position of the jaws of the first assembly component, showing the jaws in a position to grip a pin of the second locking assembly component.
Figure 6:
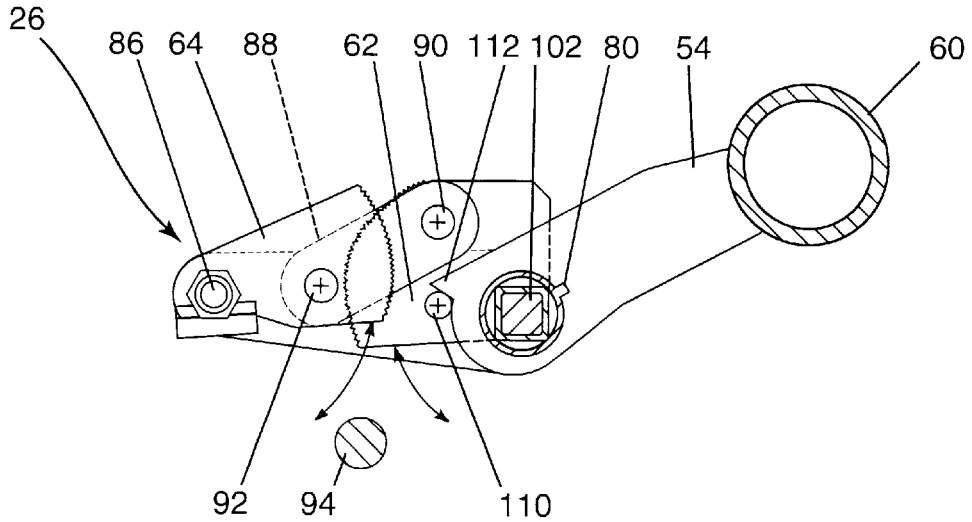
FIG. 6 a view similar to FIG. 5, showing the jaws in a position to allow the chair to rock.
Figure 7:
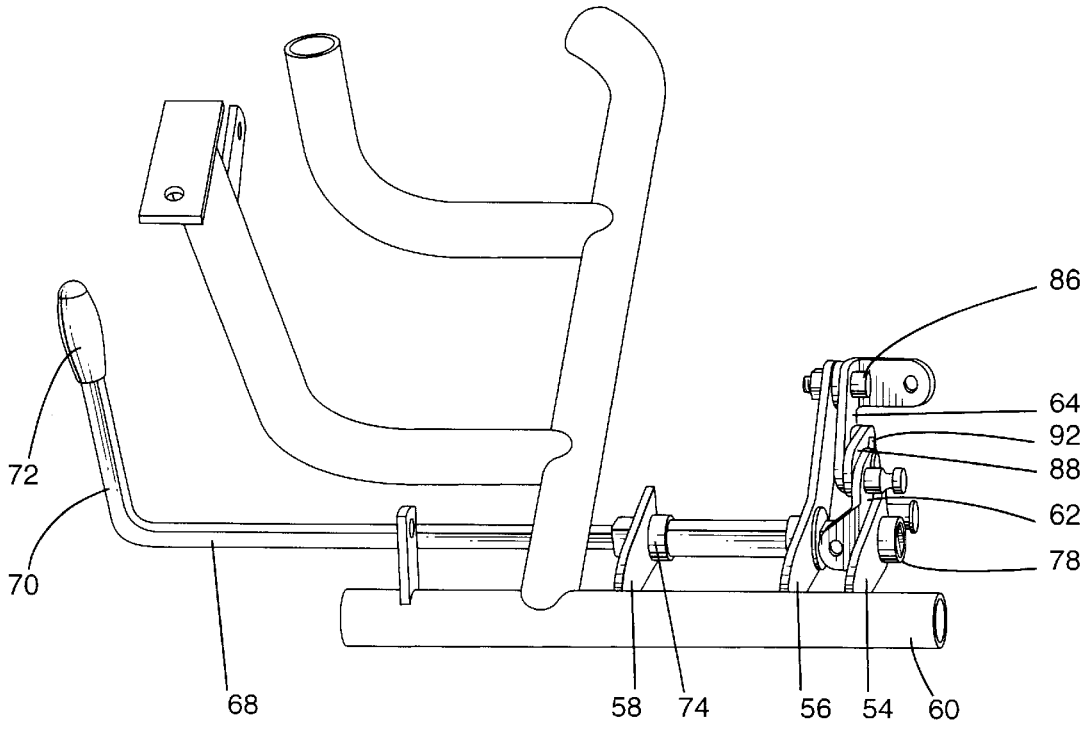
FIG. 7 is a perspective view from the top of the locking assembly in accordance with the invention, some components of the chair being also illustrated to provide a frame of reference.
Figure 8:
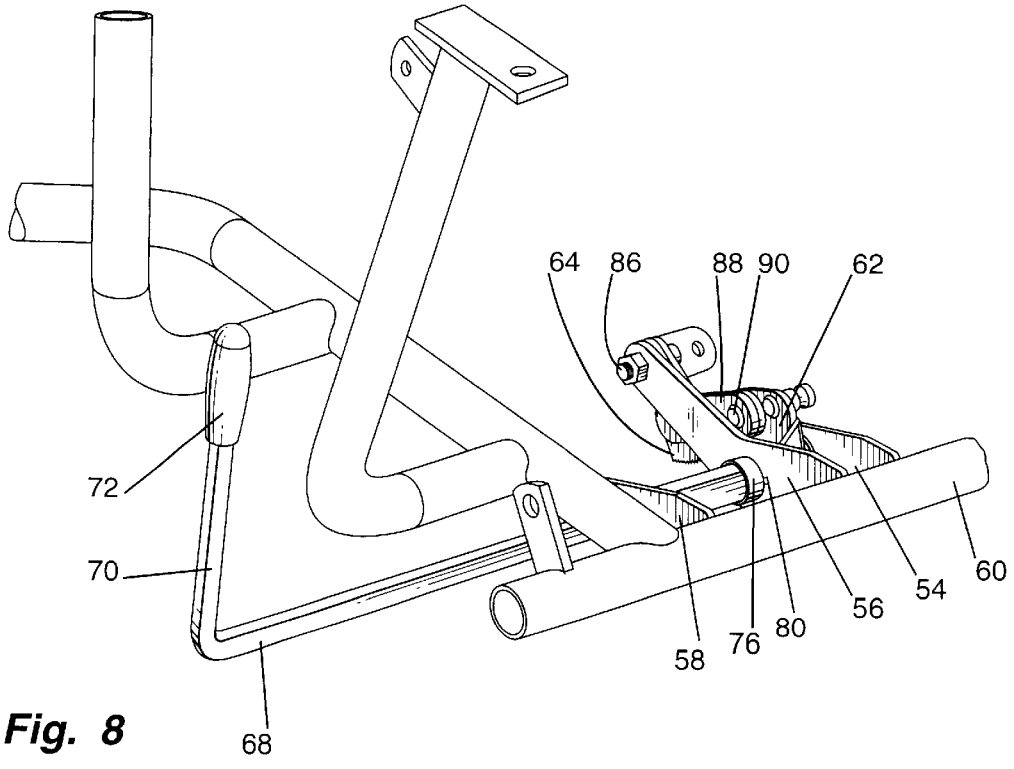
FIG. 8 is yet another perspective view from the top of the locking assembly in accordance with the invention, some components of the chair being also illustrated to provide a frame of reference.

The operation of the locking assembly 26 is shown in greater detail in FIGS. 5 and 6. In FIG. 6, the locking mechanism 26 is in the un-locked position. In this position, the jaws 64 and 62 are retracted upwardly such as to clear the pins 94, 96 and 98. This allows the chair 20 to rock since there is no interference between the first locking assembly component 50 and the second locking assembly component 52.

FIG. 5 illustrates the position of the jaws 64 and 62 when the locking assembly 26 is locked. The locking position is accomplished by causing the horizontal bar 68 to pivot by operating the handle 72. The pivotal movement of the horizontal bar 68 causes a turning motion of the jaw 62 in one direction. A similar motion but in the opposite direction is also imparted to the jaw 64 by the intermediary of the link 88. The geometrical shape of the jaws 62 and 64, in particular the shape of the curved gripping faces 82 and 84 are selected such as when the handle 72 is operated to lock the chair 20, the gripping faces 82, 84 move down and at the same time open sideways to wedge between them a pin (pin 94 shown in this example). It will be noted from FIG. 5, that the gripping face 82 has a lower portion 100 that is at a shorter distance from the pivot point 102 of the plate 54 (the point at which the plate 54 is mounted to the horizontal bar 68) than the distance between the pivot point 102 and the upper portion 104 of the gripping face 82. When each portion 100, 104 is shaped as an arc of circle it means that the radius of the arc of the portion 100 is less than the radius of the arc of the portion 104.

This configuration allows the gripping faces 82, 84 during the initial phase of the locking movement to move faster laterally (open-up) than downwards. Accordingly, the jaws 64, 62 during the initial phase of the locking movement spread laterally rapidly such as to form a receptacle 106 between their gripping faces 82, 84 and "catch" a pin 94, 96 or 98. Note that the lateral movement is effected with respect to a plane of reference that is normal to the axis of the pin 94 and also parallel to the jaws 62, 64. Subsequently, the jaws 64, 62 move down more rapidly such as to cause the pin to enter the receptacle 106 and become wedged in a pin-retention area 108 of the receptacle where the pin is engaged by both gripping faces 82, 84. If during the downward movement of the jaws 62, 64 the pin 94 is not exactly centered between the two gripping faces 82, 84, the pin 94 will initially bear on one of the gripping faces 82, 84. The tapering gripping faces 82, 84 will guide the pin toward the pin-retention area 108.

The locking assembly 26 is disengaged by rotating the horizontal bar 68 in the other direction. This causes the jaws 62, 64 to pivot in the opposite directions such as to displace the gripping faces 82, 84 first up and them laterally toward one another until the position in FIG. 6 has been reached. In this position, the pin is released from the jaws 62, 64 and the body-supporting portion 22 of the chair 20 is free to rock with respect to the chair base portion 24. To prevent the locking assembly 26 from moving beyond the position shown at FIG. 6, a stop is provided. The stop includes a pin 110 that projects from the jaw 64 and that engages a tooth 112 extending from the plate 54.

It is intended that the present application covers the modifications and variations of this invention provided that they come within the scope of the appended claims and their equivalents.

I claim:

1. A locking assembly for a rocking chair, said locking assembly being suitable for retaining a body supporting portion of the chair relative to a chair base portion of the chair in a certain position, said locking assembly comprising:

a first locking assembly component for connection to one of the body supporting portion and the chair base portion;

a second locking assembly component for connection to the other of the body supporting portion and the chair base portion;

said second locking assembly component including a pin;

said first locking assembly component including:

i. a pair of jaws;

ii. a linkage coupled to at least one of said jaws, at least one of said jaws being responsive to a first movement of said linkage to undergo displacement with relation to the other jaw such as to cause engagement of said pin between said jaws, at least one of said jaws being responsive to a second movement of said linkage to cause release of said pin between said jaws.

2. A locking assembly as defined in claim 1, wherein said second locking assembly component includes a plurality of pins selectively engageable by said jaws to interlock said first locking assembly component with said second locking assembly component.

3. A locking assembly as defined in claim 2, wherein said jaws are responsive to said first movement of said linkage such that each jaw undergoes displacement with relation to the other jaw to define a receptacle between said jaws for engaging said pin.

4. A locking assembly as defined in claim 3, wherein said jaws include gripping faces that define between them said receptacle, said gripping faces tapering toward one another to form a pin-retention area where said pin is engaged by the gripping face of each jaw.

5. A locking assembly as defined in claim 4, wherein said jaws are responsive to said first movement of said linkage such that each jaw undergoes displacement with relation to the other jaw to define a receptacle between said jaws for engaging said pin and for moving said receptacle toward said pin such as to cause said pin to enter said receptacle.

6. A locking assembly as defined in claim 5, wherein said jaws are responsive to said first movement of said linkage such that each jaw undergoes displacement with relation to the other jaw to define a receptacle between said jaws for engaging said pin and for moving said receptacle toward said pin such as to cause said pin to enter said pin-retention area of said receptacle.

7. A locking assembly as defined in claim 5, wherein said jaws pivot in response to said first movement.

8. A locking assembly as defined in claim 7, wherein in response to said first movement, one of said jaws pivots clockwise and the other of said jaws pivots counter-clockwise.

9. A locking assembly as defined in claim 8, wherein said linkage includes a rotatable bar, one of said jaws being mounted to said rotatable bar to turn therewith when said bar is rotated.

10. A locking assembly as defined in claim 9, comprising a link member between said jaws, wherein when one of said jaws is caused to rotate by said bar, said link member causes the other of said jaws to rotate.

11. A rocking chair, comprising:

a body supporting portion;

a chair base portion, said body supporting portion capable to rock with respect to said chair base portion;

a locking assembly including:

a first locking assembly component for connection to one of said body supporting portion and said chair base portion;

a second locking assembly component for connection to the other of said body supporting portion and said chair base portion;

said second locking assembly. component including a pin;

said first locking assembly component including:

iii. a pair of jaws;

iv. a linkage coupled to at least one of said jaws, at least one of said jaws being responsive to a first movement of said linkage to undergo displacement with relation to the other jaw such as to cause engagement of said pin between said jaws, at least one of said jaws being responsive to a second movement of said linkage to cause release of said pin between said jaws.

12. A rocking chair as defined in claim 11, wherein said second locking assembly component includes a plurality of pins selectively engageable by said jaws to interlock said body-supporting portion with respect to said chair base portion.

13. A rocking chair as defined in claim 12, wherein said jaws are responsive to said first movement of said linkage such that each jaw undergoes displacement with relation to the other jaw to define a receptacle between said jaws for engaging said pin.

14. A rocking chair as defined in claim 13, wherein said jaws include gripping faces that define between them said receptacle, said gripping faces tapering toward one another to form a pin-retention area where said pin is engaged by the gripping face of each jaw.

15. A rocking chair as defined in claim 14, wherein said jaws are responsive to said first movement of said linkage such that each jaw undergoes displacement with relation to the other jaw to define a receptacle between said jaws for engaging said pin and for moving said receptacle toward said pin such as to cause said pin to enter said receptacle.

16. A rocking chair as defined in claim 15, wherein said jaws are responsive to said first movement of said linkage such that each jaw undergoes displacement with relation to the other jaw to define a receptacle between said jaws for engaging said pin and for moving said receptacle toward said pin such as to cause said pin to enter said pin-retention area of said receptacle.

17. A rocking chair as defined in claim 15, wherein said jaws pivot in response to said first movement.

18. A rocking chair as defined in claim 17, wherein in response to said first movement, one of said jaws pivots clockwise and the other of said jaws pivots counter-clockwise.

19. A rocking chair as defined in claim 18, wherein said linkage includes a rotatable bar, one of said jaws being mounted to said rotatable bar to turn therewith when said bar is rotated.

20. A rocking chair as defined in claim 19, comprising a link member between said jaws, wherein when one of said jaws is caused to rotate by said bar, said link member causes the other of said jaws to rotate.

21. A rocking chair as defined in claim 12, wherein said plurality of pins are disposed along a line that extends along a path of travel followed by said jaws when said body-supporting portion rocks with respect to said chair base portion, said jaws being operative to engage a selected one of said pins to interlock said body-supporting portion with said chair base portion at a position corresponding to said selected one of said pins.

22. A rocking chair as defined in claim 14, wherein in response to said first movement said jaws undergo displacement such as to cause the gripping faces of said jaws to move away from one another and also to move toward said pin.

23. A rocking chair as defined in claim 22, wherein in response to said second movement, said gripping jaws moving away from said pin.

24. A rocking chair as defined in claim 23, wherein in response to said second movement, said gripping jaws move toward one another and also away from said pin.

* * * * *